US005890718A

United States Patent [19]

Byon

[11] Patent Number: 5,890,718

[45] Date of Patent: Apr. 6, 1999

[54] SELF-SERVICE GASOLINE PUMP SYSTEM WITH GAME FUNCTION

[76] Inventor: Ok-Sun Byon, 108-202 Parktown, 52 Sunae-dong, Bundang-gu, Songnam-shi, Kyonggi-do 463-020, Rep. of Korea

[21] Appl. No.: 32,349

[22] Filed: Feb. 27, 1998

[51] Int. Cl.[6] ..... A63F 9/00

[52] U.S. Cl. ..... 273/459; 222/255; 273/460; 463/48

[58] Field of Search ..... 273/459, 460; 463/48

[56] References Cited

U.S. PATENT DOCUMENTS 2,857,081 10/1958 Lung ..... 222/255
3,852,576 12/1974 Rudd ..... 273/460 X
4,454,670 6/1984 Bachmann et al. ..... 463/48 X
4,501,422 2/1985 Leshik ..... 463/48 X
4,869,500 9/1989 Williams ..... 463/48

*Primary Examiner*—William H. Grieb
*Attorney, Agent, or Firm*—R. Neil Sudol; Henry D. Coleman

[57] ABSTRACT

The present invention relates to a self-service gasoline pump system with game functions in which a plurality of gasoline dispensers or pumps are respectively provided with a game device, and the game devices are connected in parallel to each other and to a controller. While a dispenses gasoline, the game device performs a game automatically whenever a predetermined certain amount of gasoline or charge is reached, or manually whenever the user pushes a button for starting games, so as to offer premiums to the user according to game points. The game results are displayed under the control of the controller.

5 Claims, 6 Drawing Sheets

SELF-SERVICE GASOLINE PUMP SYSTEM WITH GAME FUNCTION

TECHNICAL FIELD

The present invention relates to a self-service gasoline pump system, and particularly to, an improved self-service gasoline pump system with game functions in which a plurality of game functions are contained so that a game program is automatically performed when a certain amount of gasoline has been pumped or when a user pushes a button for starting games, thereby offering premiums according to game points.

BACKGROUND ART

Conventionally, gasoline is pumped into automobiles by employees of gas stations in many countries and self-service has not been accepted yet due to rejection symptoms of users who are not familiar with operating the machines and due to the face-saving trends of users.

However, such self-service is has already widespread in many European countries and the need of acceptance of self-service increasing in many other countries in view of increase personnel expenses.

Therefore, motivation for users to pump gasoline themselves is increasing. The above-described conventional self-service gasoline dispenser will now be described in more detail with reference to FIG. 1.

FIG. 1 is an elevational view of a conventional self-service machine gasoline dispenser. As shown therein, the conventional self-lubricating gasoline dispenser includes a machine part 1 having a pump and a motor simply for the dispensing function, a hose and nozzle part 2, and a display part 3, so that only pumping of gasoline and metering dispensed amount and its cost are possible, which does not particularly interest users.

SUMMARY OF THE INVENTION

Accordingly, it is an object of the present invention to provide a self-service gasoline pump system with game functions, wherein it is possible to stimulate users to dispense gasoline themselves by playing electronic games while pumping gasoline and by offering premiums to the users according to results of their games, so that the self-service way of living may be accepted among users.

To achieve the above object, the present invention is basically directed to a self-service gasoline pump system with game functions which includes a plurality of gasoline dispensers or pumps each having a preset unit for setting necessary data in advance, a display unit for displaying amounts of dispensed gasoline and charges therefore, a pulse-counting unit for measuring the amounts, of dispensed gasoline a nozzle switch unit for detecting the beginning and/or the finishing of a gasoline dispensing operation, an interface part for driving all the units of the respective gasoline pump, and a control part for controlling all the units of the respective gasoline pump. The system further comprises a plurality of game devices each installed in a respective one of the gasoline pump and each having a communication unit connected to the interface part of the respective gasoline pump, a display unit for displaying current status of the game device and/or results of a game played by a user, a key pad unit for setting modes of the game device, a game unit for performing electronic games programs, and a control part for controlling all the units of the game device. The system also comprises controller for multiple game devices of multiple pumps having a communication unit which is connected to the communication units of the individuals game devices, a display unit, a key pad unit, and a control part for controlling all the units of the controller, wherein the controller transmits an order to any one of the game devices for performing an electronic game of one round via the interface part of the respective gasoline pump, when the user pumps gasoline of a certain amount, wherein the controller for the game devices enables the game unit of the game device to perform a game of one round when the game order is input through the communication unit of the respective game device. The game unit of each game device detects and transmits game result data to the controller for the game devices via the respective communication unit of the game device, and the control part of the controller for game devices receives the game result data and displays it via the display unit of the controller.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DISCLOSURE OF THE INVENTION

A self-service gasoline pumps system with game functions will now be described with reference to FIG. 2 through FIG. 8.

Figure 1:
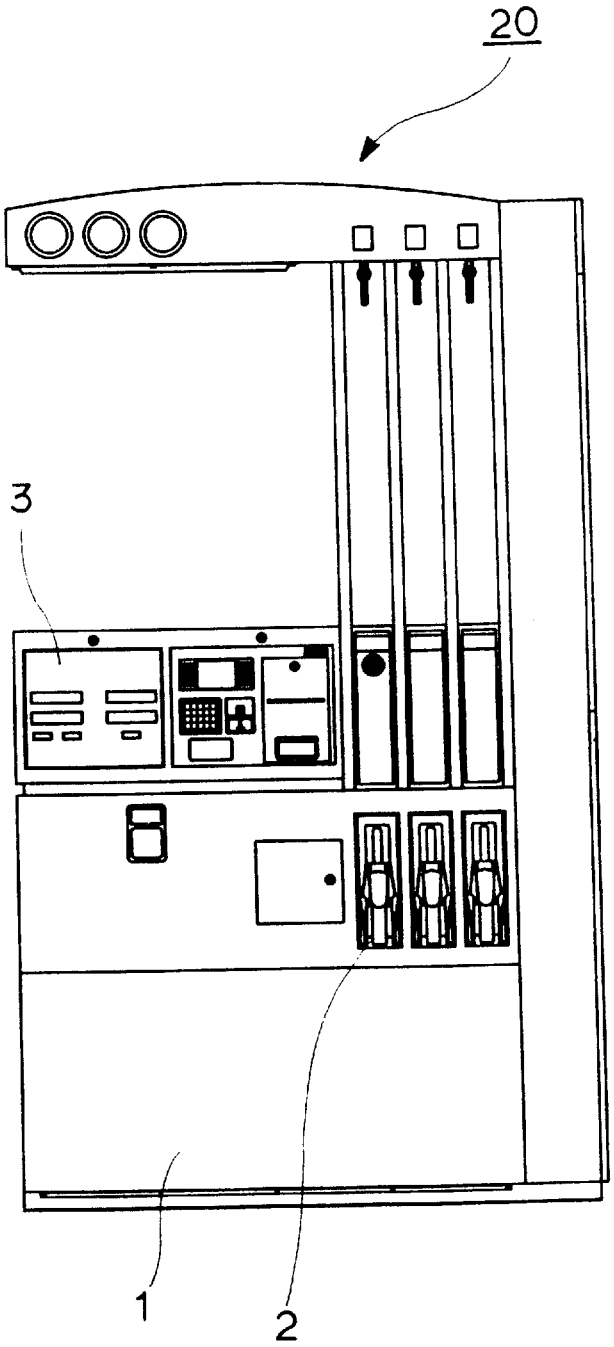
FIG. 1 PRIOR ART
FIG. 1 is a schematic exterior view of a conventional self-service system gasoline dispenser or pump.
Figure 2:
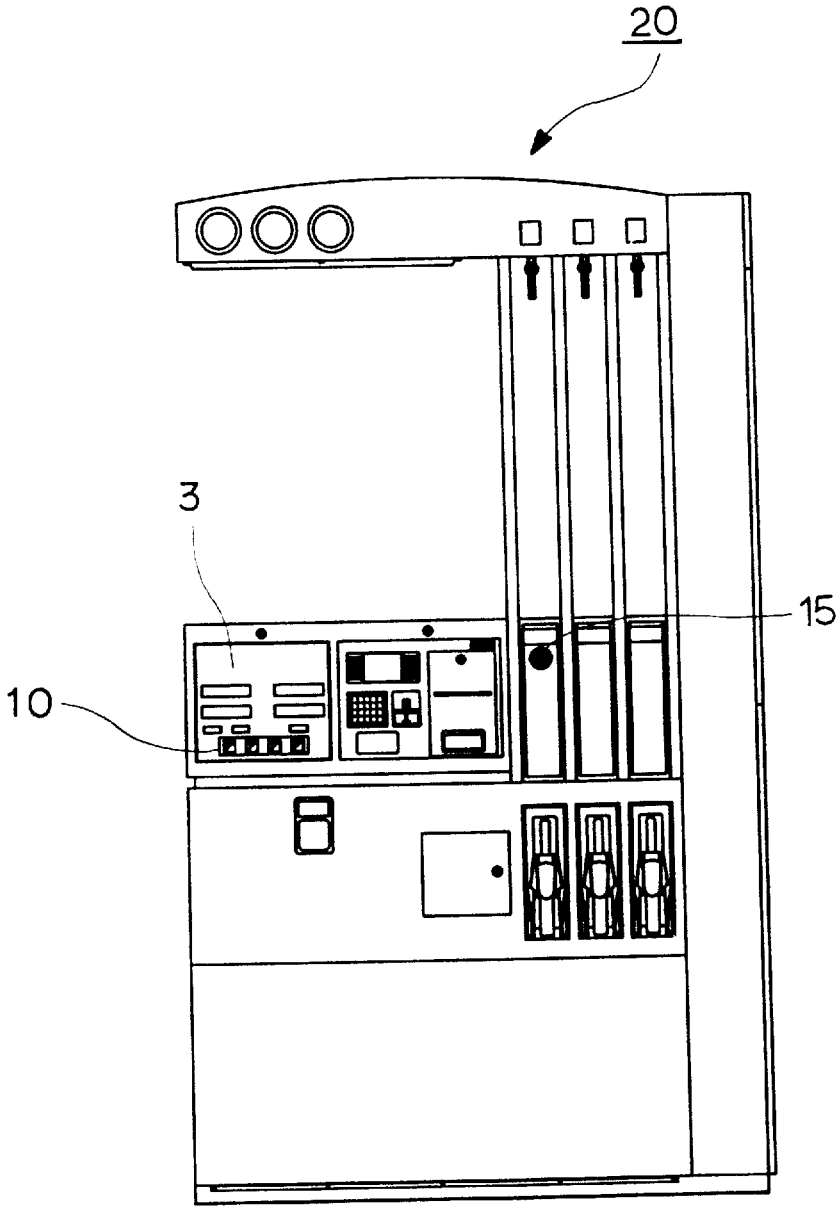
FIG. 2 is a schematic exterior view of a self-service system with game functions according to a preferred embodiment of the present invention.

FIG. 2 is an exterior view of a self-service gasoline pumps system with game functions according to a preferred embodiment of the present invention. As shown in FIG. 2, a game device 10 is provided to a on a gasoline pump assembly 20 so that a user may play electronic games while dispensing gasoline, thereby interesting the user in dispensing gasoline himself from pump assembly 20.

Figure 3:
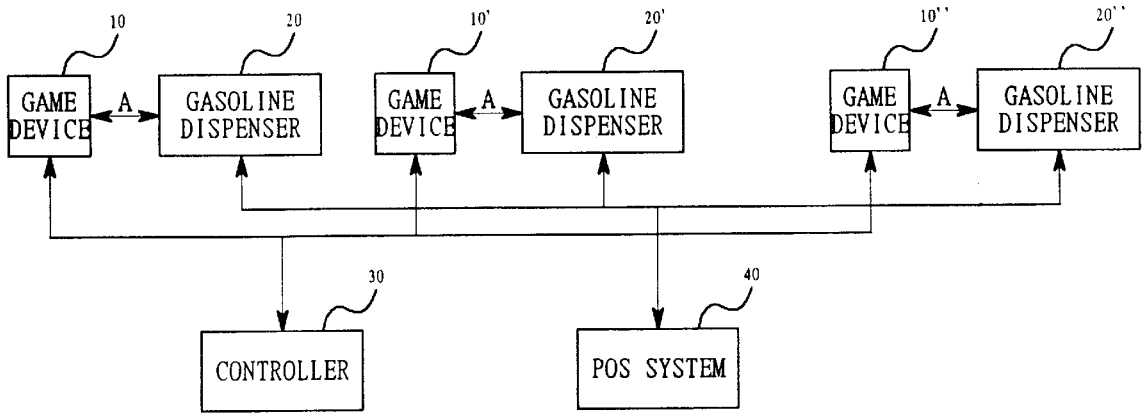
FIG. 3 is a schematic block diagram depicting linkage among a plurality of game devices, a plurality of gasoline dispensers, a controller for the game devices and a POS system according to the present invention.

FIG. 3 is a schematic block diagram showing interrelation along connection lines between a plurality of game devices 10, 10', 10", a plurality of gasoline dispensers or pump assemblies 20, 20', 20", a controller 30 for the game devices and a POS system 40 according to the present invention. As shown FIG. 2, one gasoline dispenser or pump assembly 20 is provided with one game device 10 and a communication line A connects the gasoline dispenser or pump assembly 20 and the game device 10.

In the prior art, respective gasoline dispensers or pump assemblies 20, 20', . . . , 20" are connected in parallel to a POS system 40 by means of a POS communication line. It is also possible to use the gasoline dispensers or pump assemblies without the POS system 40.

On the other hand, in a self-service gasoline pump system with game functions in accordance with the present invention, communication lines for the game devices are additionally provided to connect respective game devices 10, 10', . . . , 10" in parallel to a controller 30 for the game devices.

Such a parallel connection is usually achieved by means of RS-485 but is not limited thereto and any other connection methods for parallel communication may be employed.

Figure 4:
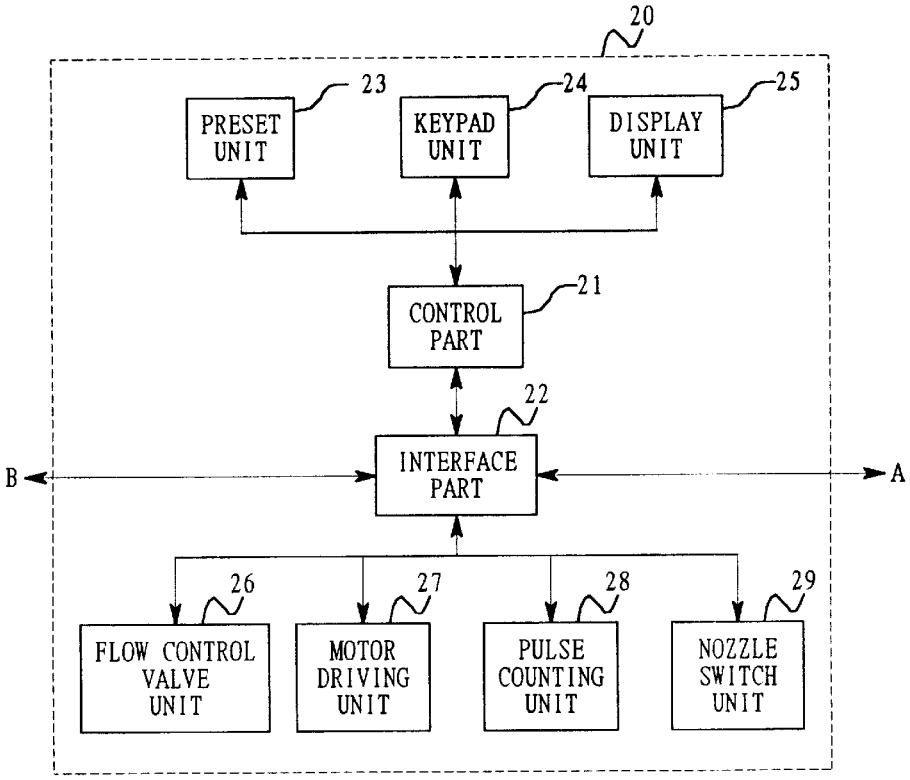
FIG. 4 is a schematic block diagram illustrating a construction of a self-service gasoline pump system with game functions according to a preferred embodiment of the present invention.

FIG. 4 is block diagram of a gasoline dispenser or pump assembly 20, 20', 20". In FIG. 4, the construction of the gasoline dispenser is that of the prior art gasoline dispenser or pump assembly, except for parts communicating with the game devices 10, 10', 10".

That is, the gasoline dispenser or pump assembly 20 includes a control part 21 for controlling operation of the gasoline dispenser or pump assembly 20 as a whole, an interface part 22 for controlling peripheral equipments according to instructions from the control part 21 and for communicating with a POS system 40 (FIG. 3) when the POS system is connected thereto, a procontrol valve unit 26 for controlling gasoline valve, a motor driving unit 27 for driving a motor of a pump, a pulse counting unit 28 for counting out an amount of dispenser gasoline and/or charges therefore, a nozzle switch unit 29 for detecting whether or not a nozzle switch is pressed by the user for gasoline pump, a preset unit 23 for inputting a an amount of gasoline and/or its charge in advance to implement a precise lubrication, a key pad unit 24 for inputting information such as identification symbols of the gasoline dispenser or pump assemblies 20, unit prices of gasoline, function modes and the like, and a display unit 24 for displaying information such as amounts of dispensed gasoline and/or charges therefore, wherein detailed description of operation of the gasoline dispensers or pump assembly is omitted since it is the same as the prior art gasoline dispensers or pump assemblies.

In the gasoline dispensers or pump assemblies 20 according to the present invention, the interface part 22 is connected to a circuit for communication with the game device 10 and the communication line A, and the control part 21 is added with programs for operation in association with the game devices 10.

The circuit for communication with the game device 10 may employ communication method RS-485 which is usually utilized in the prior art. It is also possible to use other general communication methods such as RS-232 or to derive a new communication method.

Detailed description of the operation in association with the control part 21 and the game device 10 will be followed hereinafter.

Figure 5:
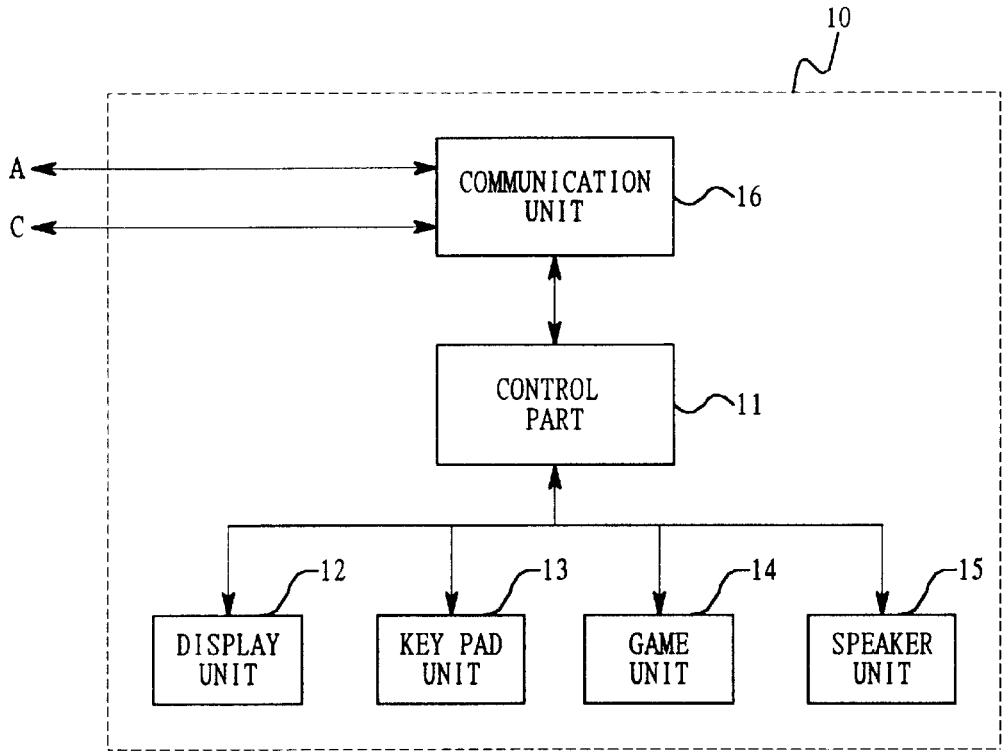
FIG. 5 is a schematic block diagram showing a construction of a game device of a self-service gasoline pump system with game functions according to a preferred embodiment of the present invention.

FIG. 5 is a schematic block diagram for explaining construction of the game device 10 of a self-service gasoline pump system system according to the present invention.

In FIG. 5, the game device 10 includes a control part 11 for controlling operation of the game device 10, as a whole display unit 12 for displaying information such as kinds of game, prize winners, winning grades and the like, a key pad unit 13 having buttons to be pressed by the user for selecting kinds or modes of games, a game unit 14 for performing a certain game according to a selection made via the key pad unit 13, and a speaker unit 15 for generating sound effects and informing the user of game-related matters.

The display unit 12 may include lamps, LEDS, LCDS and the like. The speaker unit 15 is provided with prerecorded tapes or IC memories to generate guide or instructural messager such as "Please press a starting button in the game device!" when the user dispenses a certain amount of gasoline or more, "You won the prize!" when the user wins a prize, and so on.

The game device 14 contains various electronic games, for example, electronically realized slot machine games, quiz games, shooting games, etc, and premiums are offered to the user according to game score of the user. In this case, a time period for playing a game should not be too long since a time period for filing and automobile gas tank is not long.

Figure 6:
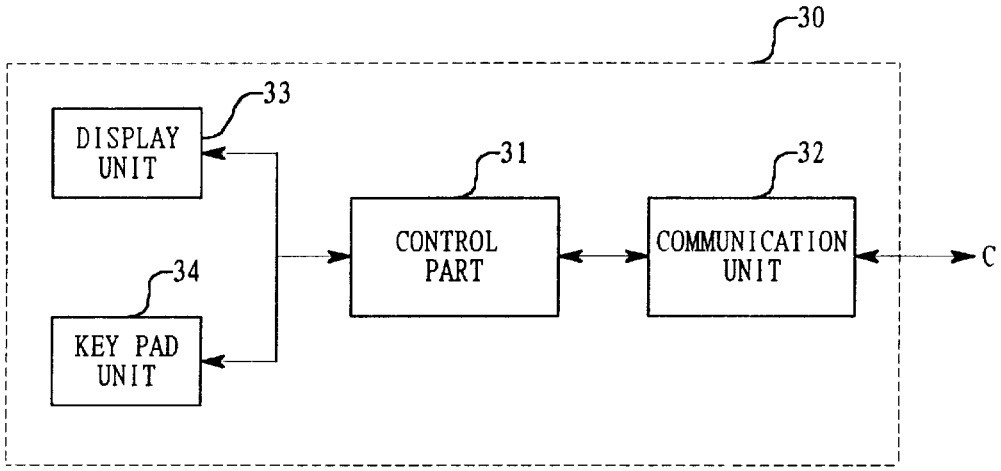
FIG. 6 is a schematic block diagram of a construction of a controller for game devices of a self-service gasoline pump system with game functions according to a preferred embodiment of the present invention.
Figure 7:
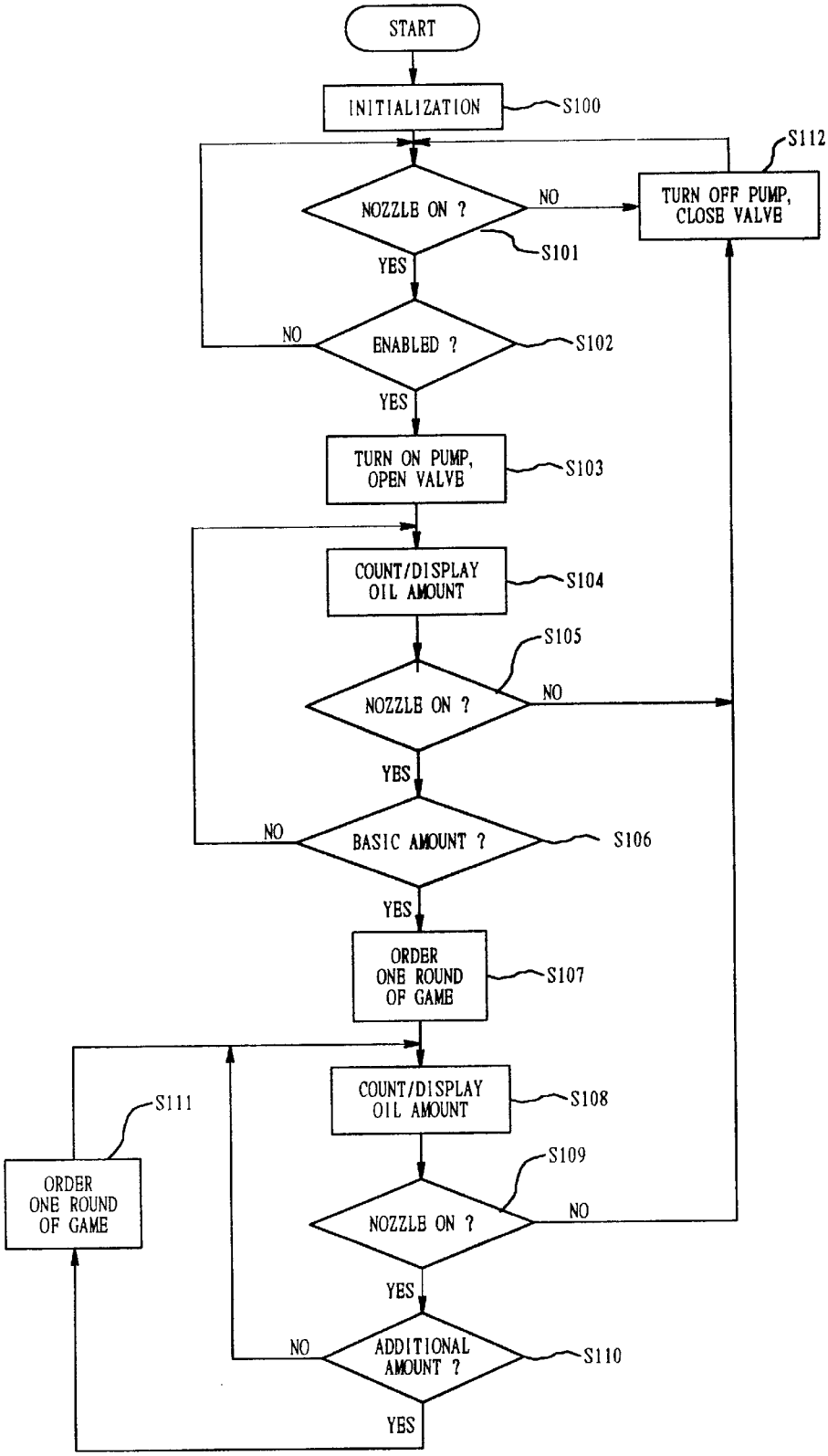
FIG. 7 is a flow chart detailing operation of a control part of the gasoline pumps according to a preferred embodiment of the present invention.

FIG. 6 is a schematic block diagram of a controller 30 for game devices 10, 10', 10". In FIG. 6, the controller 30 for game devices 10, 10', 10" includes a control part 31 for controlling the operation of the controller 30 as a whole, a communication unit 32 for communicating with the game device 10, 10', 10" a display unit 33 for displaying information such as symbols of winners, contents of prize, etc., and a key pad unit 34 for inputting data for setting conditions for playing a game by the game device or resetting the game device, wherein the display unit 33 may further include lamps, LEDs, LCDs, and the like.

Now, the operation of the gasoline dispenser or pump system with game functions will be described in more detail with reference to FIG. 5 to FIG. 8.

First, if a driver presses the nozzle switch after putting a gasoline pump nozzle into an injection hole or tank inlet of his car, the control part 21 detects the pressing of the nozzle switch by means of the nozzle switch unit 29 and drives the procontrol valve unit 26 to open a procontrol valve. Then the motor driving unit 27 drives the motor to supply or dispense gasoline.

In this case, the pulse counting unit 28 counts out the amount of dispensed gasoline and the display unit 25 displays the counted value of the dispensed gasoline and/or its charge, under the control of the control part 21. When the counted gas amount reaches a predetermined amount (basic gas amount), the control part 21 transmits an order for performing a game of one round.

When the control part 11 of the game device 10 receives the order, the control part 11 initiates a game for one time by turning-on a game starting lamp in the display unit 12 or generating an audible message via the speaker unit 15 to play a game. When the user presses the starting button for playing a game and plays the game, the result is displayed Via the display unit 12 and transmitted to the controller 30" for game devices 10,10',10".

According to the result of the game played by the user, when the control part 21 transmits an order to the game device 10 to perform one more round of the game, the user may play the game again without pressing the starting button since the game device 10 starts the game automatically.

After the continuous game is finished and a result is reached, the controller 30 for the game devices 10, 10', 10" controls the display unit 33 to display prize grades of winners and symbols of their pump assemblies according to the game results, thereby terminating all operations of the self-service gasoline pump system with game functions.

The game device 10 maybe enabled to perform game programs per predetermined gasoline amounts or charges. Now, referring to a flow chart of FIG. 7, the operation of the control part 21 of the gasoline dispenser or pump assembly 20 will be apparent from the detailed description hereinafter.

When power is provided to the gasoline dispenser or pump assembly 20, the control part 21 performs initialization by initializing hardware and setting initial values of software (step S100) and checks whether or not the gas pump nozzle is turned-on, that is, whether a user has commenced gasoline dispensing or not (step S101).

If the gasoline dispensing is not begun yet, the pump is maintained in a turned-off state (step S112) and state of the pump nozzle is continuously checked (step S101).

When the gasoline pumping is begun, that is, when the pump nozzle is turned on, it is checked again whether or not the gasoline pumping has been enabled (step S102). The gasoline pumping may be not enabled when the pump is out of order, the POS system is out of order, payment is not made under the condition of advance payment, etc., and these reasons may be set by means of the POS system.

When it is determined that the gas pumping is not enabled at step S102, the step S101 is carried again and the above routine from step S101 to step S102 is repeated until it is determined that the pump is enabled.

When the enabled pump is determined, the procontrol valve unit 26 and the motor driving unit 27 are controlled to open the valve and to drive the motor so as to supply gas (step S103). While supplying gas, the gas amount is continuously detected by the pulse counting unit 28 to display it to the display unit 25 (step S104).

If the pump nozzle is not turned off and gasoline is dispensed continuously a check is made as to whether or not the amount of dispensed gas reaches at a predetermined basic amount (step S106), and step S104 to step S105 are repeatedly performed if the amount of dispensed gasoline is less than the predetermined basic amount.

If it is determined that the amount of dispensed gasoline is more than the predetermined basic amount at step S106, the interface part 22 transmits an order to the game device 10 for performing a game for one round (step S107).

Operation which is performed when the game device 10 receives the order to perform a game for one time will be described hereinafter.

When the order for one round of game performance is transmitted, step S108 to step S111, which are similar to step S104 to step S107, are repeatedly performed, but now it is checked whether additional dispensed gasoline reaches a predetermined additional amount over the predetermined basic amount or a former amount of dispensed gasoline.

For example, at first, an opportunity for playing a game for a first round is given to the user when the user pumps a basic amount of gasoline, for example, U.S.$10.00 worth and then an opportunity for playing the game for a second round is given to the user when the user pumps a predetermined additional amount of gasoline, for example, U.S.$ 2.00 worth, wherein the basic pumping conditions, or the additional conditions, such as the amounts gasoline, the charges thereof, gasoline type or number, etc. may be adjusted.

When the gasoline pumping lubrication is finished, it is determined in step S104 to step S106 whether the gas nozzle is turned off (step S109). Then, the pump is turned off and valve is closed (step S112) and the first step S101 is carried out again.

Figure 8:
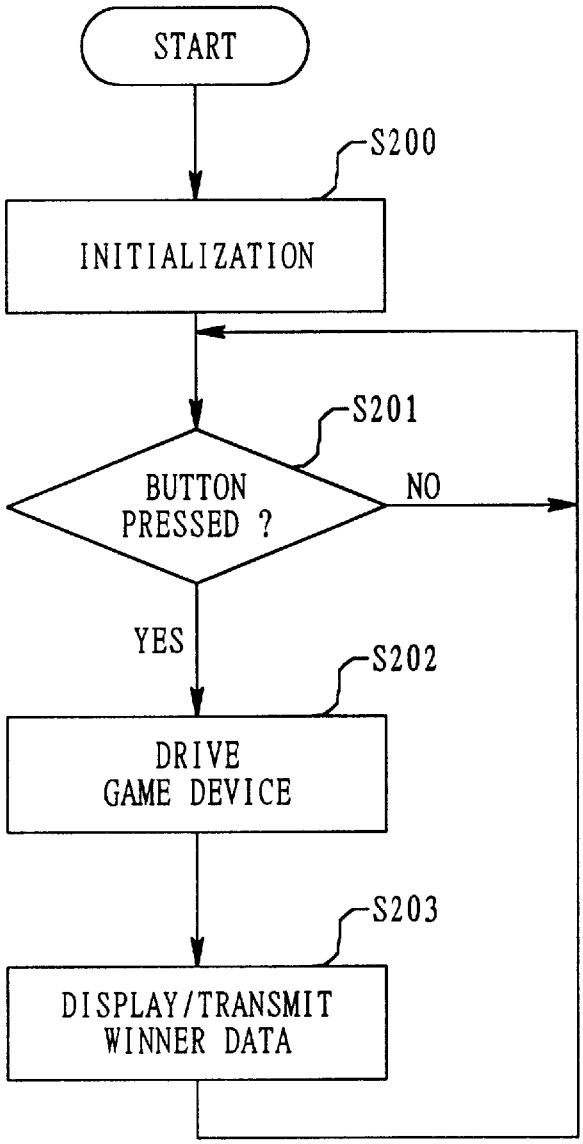
FIG. 8 is a flow chart of the operation of the control part of the game devices according to a preferred embodiment of the present invention.

Now, operation of the control part 11 of the game device 10 is fully described with reference to FIG. 8.

When power is provided to the game device 10, the control part 11 performs initialization of hardware and software (step S200) and checks whether or not the starting button for playing a game is pressed or not to order to a game for one round of play (step S201).

If the play order is transmitted from the gasoline dispenser or pump assembly 20 and the starting button for playing a game is pressed, the game device 10 is induced to perform a game one time (step S202). When a game performance order is transmitted to the game unit 14 of the game device 10 to start a game, an audible message, for example, "Please press the starting button in the game device!" may be generated Via the speaker unit 15 or a game starting indicator light may be turned on.

It is also possible to perform a game for one round automatically by the game unit 14 without the user's pressing of the game starting button.

The display unit 12 and/or the speaker unit 15 respectively detects and the users of the result of the game played by the user and, at the same time, the result is transmitted to the game device controller 30 through the communication unit 16 (step S203).

If a of one round is finished, step S201 is carried again and the above routine from step S202 to step S203 is repeated. Therefore, an opportunity for playing a game for a first round is given to the user when the user dispenses a basic amount of gasoline and then an opportunity for playing the game for a second round is continuously given to the user whenever the user dispenses a further predetermined additional amount of gasoline.

Now, operation of the game device controller 30 is described here in more detail with reference to FIG. 2. When the controller 30 receives data pertaining game results from the game device 10, 10', 10" the display unit 33 displays the results, and particularly information such as winning gas pump symbols, prize grades, and the like.

The information is also provided to the employees of the gas station by means of buzzer sounds and the like so that the whole operation of the self-service gasoline pump system with game functions is finished and the user may win a prize according to the displayed contents.

As described hereinabove, by using the self-service gasoline pump system with game functions according to the present invention, it becomes possible to increase consumer acceptance of self-service by giving strong and interested motivation to users who are not familiar to operate machines and have the face-saving trends.

What is claimed is:

1. A self-service gasoline pump system with game functions comprising:

a plurality of gasoline dispensers each having a preset unit for setting necessary data in advance, a display unit for displaying dispensed gasoline amounts and charges therefore, a pulse-counting unit for measuring the amount of dispensed gasoline, a nozzle switch unit for detecting a beginning and finishing of a gasoline dispensing operation, an interface part for driving all the units of the gasoline dispenser, and a control part for controlling all the units of said gasoline dispenser;

a plurality of game devices installed in respective ones of said gasoline dispensers, said games devices each having a communication unit connected to said interface part of the respective gasoline dispenser, a display unit for displaying current status of the respective game device and results of a game played by a user, a key pad unit for setting modes of the respective game device, a game unit for performing electronic games programs, and a control part for controlling all the units of the respective game device; and a controller for said game devices having a communication unit which is connected to the communication units of said game devices, a display unit, a key pad unit, and a control part for controlling all the units of said controller;

wherein the control part of each of said gasoline dispensers transmits an order to the respective game device for performing an electronic game of one round via the interface part of the respective gasoline dispenser, when the user dispenses gasoline of a certain amount;

wherein said controller enables the game unit of each of said game devices to perform a game of one round when a game order is input through the communication unit of the respective game device, and the game unit of the respective game device detects and transmits game result data to said controller for said game devices via the communication unit of the respective game device; and wherein the control part of said controller receives the game result data and displays it via the display unit of said controller.

2. The system of claim 1, wherein each of said game devices further includes a speaker unit for generating sound effects to guide or inform users of operation method and game results while operating the respective game device.

3. The system of claim 1, wherein each of said game devices contains electronic game programs which may be performed by pressing a button at predetermined amounts of dispensed gasoline, charges or numbers.

4. The system of claim 1, wherein said key pad unit of each of said game devices further includes a button to be pressed for starting a game.

5. The system of claim 2, wherein at least one gasoline dispenser is provided which operates independently from the game devices.

* * * * *